US006308502B1

(12) United States Patent
Olson et al.

(10) Patent No.: US 6,308,502 B1
(45) Date of Patent: Oct. 30, 2001

(54) BARREL CAM LOADER ARM ASSEMBLY

(75) Inventors: Allen Olson, Crosby; Gerald Geisenhof, Fort Ripley, both of MN (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/476,011

(22) Filed: Dec. 29, 1999

(51) Int. Cl.[7] ..... B65B 35/30
(52) U.S. Cl. ..... 53/534; 53/252; 53/543
(58) Field of Search ..... 53/252, 258, 77, 53/534, 543, 556, 547, 548; 74/581, 584, 599; 100/341, 346

(56) References Cited

U.S. PATENT DOCUMENTS

| | | | | |
|---|---|---|---|---|
| 3,821,874 | * | 7/1974 | Jones | 53/252 |
| 4,250,693 | * | 2/1981 | Andersson | 53/543 |
| 4,802,324 | | 2/1989 | Everson . | |
| 4,936,077 | * | 6/1990 | Langen et al. | 53/543 |
| 4,982,556 | * | 1/1991 | Tisma | 53/252 |
| 5,036,644 | | 8/1991 | Lashyro et al. . | |
| 5,347,796 | | 9/1994 | Ziegler et al. . | |
| 5,388,389 | * | 2/1995 | Tisma | 53/252 |

OTHER PUBLICATIONS

Riverwood International Corporation, Illustration of a barrel cam loader–Side View (A).
Riverwood International Corporation, Illustration of a portion of a barrel cam loader–End View (B).
Riverwood International Corporation, Illustration of a portion of a barrel cam loader–End View (C).

* cited by examiner

*Primary Examiner*—Peter Vo
*Assistant Examiner*—Louis K. Huynh
(74) *Attorney, Agent, or Firm*—Skinner and Associates; Steve McLary

(57) ABSTRACT

A loader arm assembly for use in a packaging system, comprising an arm, a housing, and a load jam detector. The housing is operably connected to at least one motive mechanism, and is adapted for moving the arm to load product into a package. The arm has both a latched state and a released state with respect to the housing. The arm normally is in the latched state to load product into the package, and enters the released state to relieve pressure upon detecting the load jam condition. The arm includes a base plate and a loading head. The housing is formed with a guide passage that is adapted for receiving the base plate. The load jam detector preferably includes at least one detent adapted for holding the base plate with respect to the housing in the latched state. The detent preferably is formed by a tip of at least one plug extending through the housing to the guide passage. The tip is adapted for applying a holding force against the base plate. A first end of the base plate has at least one depression adapted for receiving the tip of the at least one plug in the latched state and for releasing the tip to slide on a surface of the base plate upon the application of a predetermined load pressure attributable to the load condition. The loader arm assembly is described and shown within a barrel cam loading mechanism that is incorporated into a continuous motion packaging mechanism, but may be used in other packaging systems such as a vertical cartoner or a sleever.

13 Claims, 7 Drawing Sheets

BARREL CAM LOADER ARM ASSEMBLY

BACKGROUND OF THE INVENTION

1. Field of the Invention

The present invention relates, generally, to apparatus and methods in the packaging industry. More particularly, the invention relates to a barrel cam loader arm assembly incorporated into a barrel cam loading mechanism used within a packaging system.

2. Background Information

The state of the art in general includes various packaging devices and methods. These devices and methods are believed to have significant limitations and shortcomings. Specifically, the article groups may jam within an article group transfer mechanism and may damage the articles or the carton. One solution for detecting and relieving pressure associated with a load jam is described in U.S. Pat. No. 5,347,796, owned by the applicants' assignee, which discloses a release mechanism that is connected to a cam assembly in the article group transfer mechanism. The release mechanism, such as a pressure release cylinder and piston, is controlled by a sensing mechanism such as a photoeye or capacitive proximity sensor. An excessive force placed on the outer rail of the cam assembly due to a jamming of the arm assembly, for example, will actuate the release mechanism enabling the outer rail to pivot away. However, the amount of force required to actuate the release mechanism will vary depending on where the loader arm is with respect to the pivot point on the outer rail assembly, i.e. more force is required near the pivot point and less force is required away from the pivot point. Additionally, once the release mechanism is actuated due to a jam, multiple lanes of articles and packages may be damaged, which requires an operator to clean and reset each of these lanes.

This invention provides each barrel cam loader arm assembly within the barrel cam loading mechanism with an independent means for detecting a load jam that is believed to constitute an improvement over existing technology. The sensitivity of the independent means for detecting a load jam is adjustable to account for the degree that the articles and packages are sturdy or delicate, and it remains constant or consistent as each arm assembly travels within the loader arm assembly.

BRIEF SUMMARY OF THE INVENTION

The present invention provides a loader arm assembly incorporated into a barrel cam loading mechanism used within a packaging system such as a cartoner or a sleever. The loader arm assembly generally comprises an arm, a housing, and means for detecting a load jam condition. The housing is operably connected to at least one motive mechanism and is adapted for moving the arm to load product into a package. The arm has both a latched state and a released sate with respect to the housing. The arm normally is in the latched state to load product into the package, and enters the released state to relieve pressure upon detecting the load jam condition. The arm includes a base plate and a loading head.

The base plate has a first end and a second end. The housing is formed with a guide passage that is adapted for receiving the base plate. The means for detecting a load jam preferably includes at least one detent adapted for holding the base plate with respect to the housing in the latched state. The detent(s) preferably is formed by a tip of at least one plug extending through the housing to the guide passage. The tip is adapted for applying a holding force against the base plate. The first end of the base plate has at least one depression adapted for receiving the tip of the plug(s) in the latched state and for releasing the tip to slide on a surface of the base plate upon the application of a predetermined load pressure attributable to the load jam condition.

The motive mechanism(s) includes a flight chain and guide tube assembly adapted for providing a longitudinal motion to the housing and a control cam assembly operably positioned with respect to the flight chain and guide tube assembly to provide a lateral motion to the housing. The flight chain and guide tube assembly includes a parallel pair of flight chains and at least one guide tube connected to and extending between the flight chains. The housing has at least one guide tube aperture adapted for slidably receiving the guide tube(s), and includes a cam follower adapted for operably contacting the control cam assembly. The control cam assembly engages and influences the housing to laterally move along the guide tube(s) as the flight chain and guide tube assembly longitudinally transport the housing and the arm in a longitudinal direction.

The housing includes a body portion and a cover portion removably attached to the body portion. Both the body portion and the cover portion have cooperating channels to form the guide passage adapted for receiving the base plate and for laterally moving the arm to load product into a package if the arm is and remains in the latched state. The plug(s) extends through the cover portion to the guide passage. The plug(s) and depression(s) provide the arm with both the latched state in which the arm moves laterally with the housing and the released state in which the arm does not move laterally with the housing. The plug(s) have threads and extend through a threaded aperture in the cover portion. The holding force corresponding to the predetermined load pressure that is attributable to the load jam condition may be adjusted by turning the plug(s) or by using more or fewer plug(s). Therefore, each arm assembly in the barrel cam loading mechanism has an independent means for detecting a load jam that has a sensitivity that is adjustable to account for the degree that the articles and packages are sturdy or delicate, and is constant or consistent as each arm assembly travels within the loader arm assembly.

The loader arm assembly is described and shown within a barrel cam loading mechanism that is incorporated into a continuous motion packaging mechanism. The barrel cam loading mechanism generally comprises a plurality of the loader arm assemblies described above, a flight chain and guide tube assembly, and a control cam assembly. The flight chain and guide tube assembly is adapted for providing a longitudinal motion to the housing of each of the loader arm assemblies, and generally includes a parallel pair of longitudinally oriented flight chains and at least one guide tube for each of the plurality of loader arm assemblies connected to and laterally extending between the flight chains. The guide tube(s) has a slidable fit within guide tube aperture(s) in the housing. The plurality of loader arm assemblies are disposed along the flight chains at predetermined longitudinally spaced intervals. The control cam assembly is operably positioned proximate to the flight chain and guide tube assembly to provide a lateral motion to the housing of each of the loader arm assemblies. The control cam assembly influences the housing to laterally move along the guide tube(s) as the flight chain and guide tube assembly longitudinally transports the housing.

The packaging system may be a continuous motion packaging mechanism, or cartoner, which generally comprises a carton supply and transport mechanism, an article supply mechanism, an article group selection and transport mechanism, and the barrel cam loading mechanism described above. The carton supply and transport mechanism is adapted for providing a linear stream of longitudinally spaced carton sleeves. The article supply mechanism is adapted for providing streams of articles to a predetermined position. The article group selection and transport mechanism is disposed adjacent and parallel to the carton supply and transport mechanism, and is adapted for metering the articles provided by the article supply mechanism into predetermined article groups and for transporting a linear stream of longitudinally spaced article groups that are aligned with the carton sleeves, thus enabling the barrel cam loading mechanism to load the article groups into the carton sleeves. An example of a high-speed cartoner is described in U.S. Pat. No. 5,347,796, owned by the applicants' assignee, and is herein incorporated by reference. Alternatively, the packaging system may be a vertical cartoner or a sleever. An example of a vertical cartoner is described in U.S. Pat. No. 4,802,324 and an example of a sleever is described in U.S. Pat. No. 5,036,644, both of which are owned by the applicants' assignee and are herein incorporated by reference.

The features, benefits and objects of this invention will become clear to those skilled in the art by reference to the following description, claims and drawings.

DETAILED DESCRIPTION

Figure 4:
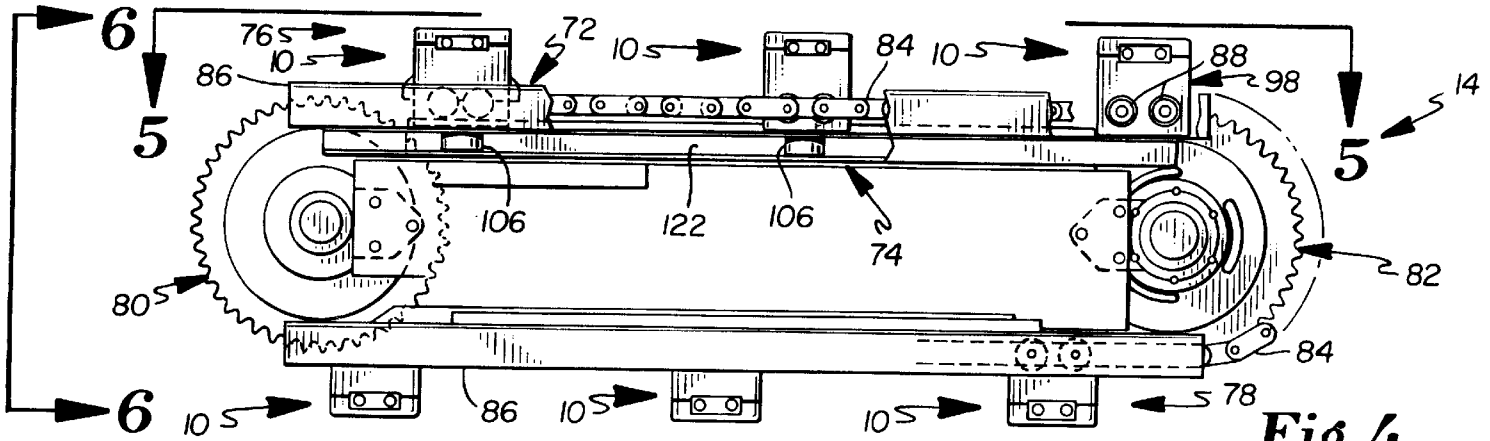
FIG. 4 is a side view of the barrel cam loading mechanism incorporating the loader arm assembly of the present invention.
Figure 5:
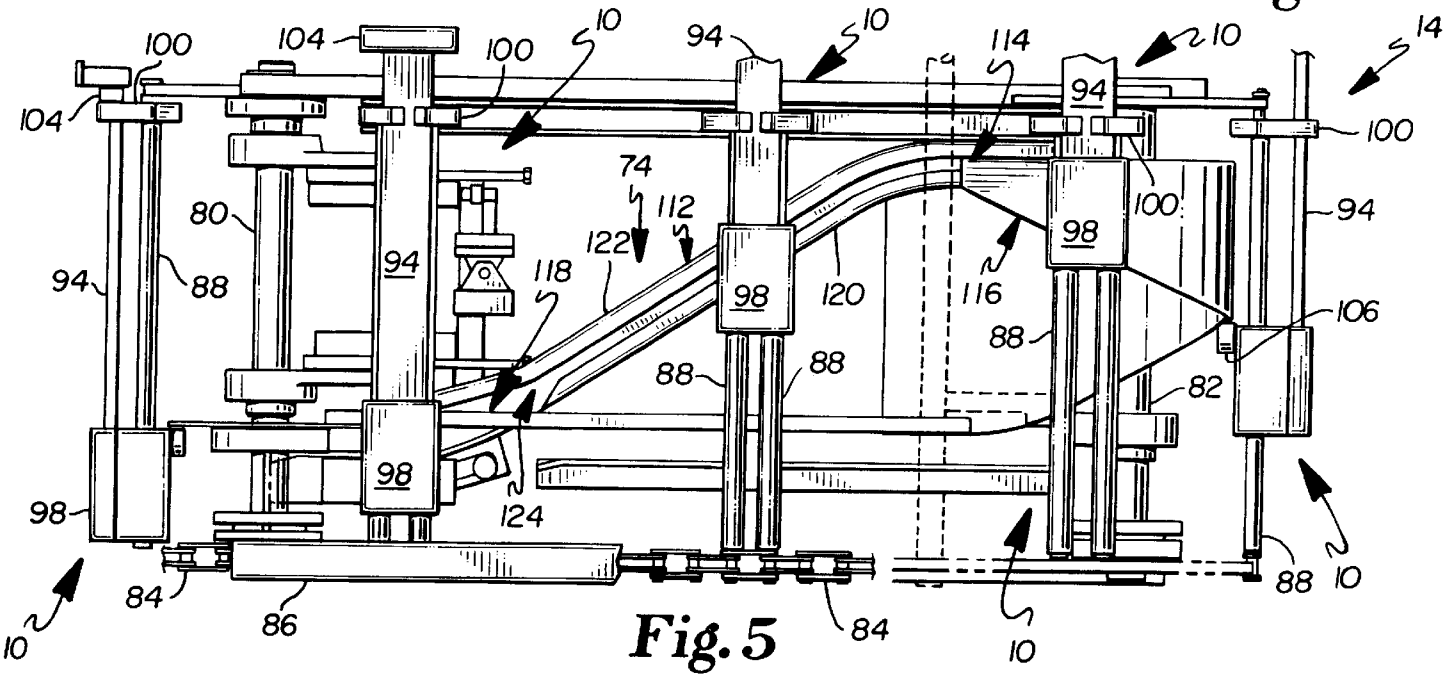
FIG. 5 is a top view of the barrel cam loading mechanism taken along line 5—5 of FIG. 4.
Figure 6:
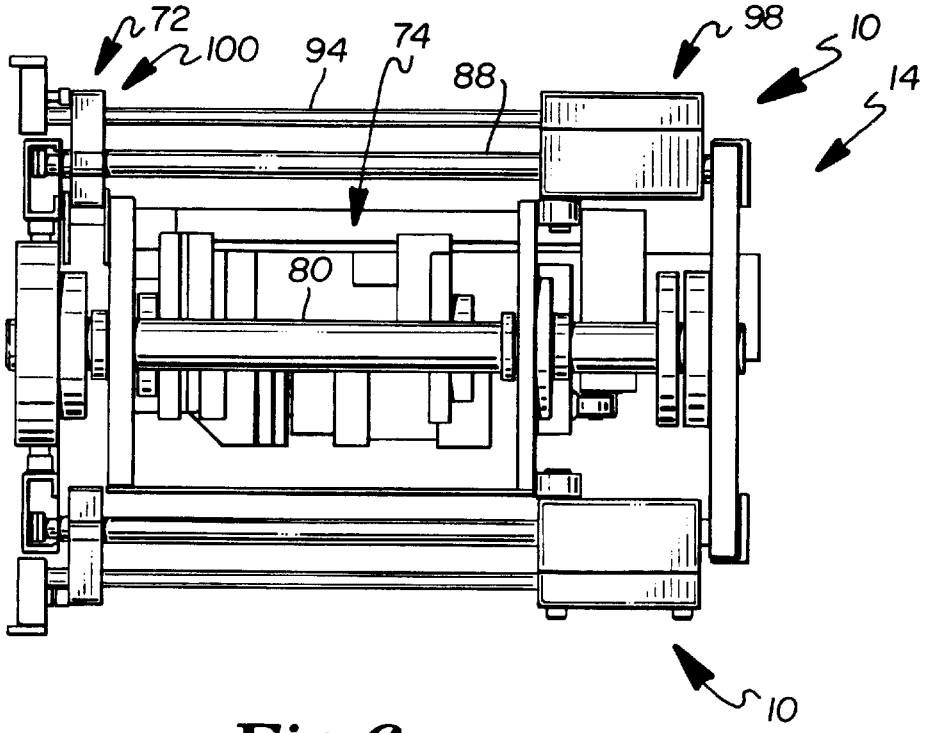
FIG. 6 is an end view of the barrel cam loading mechanism taken along line 6—6 of FIG. 4.
Figure 7:
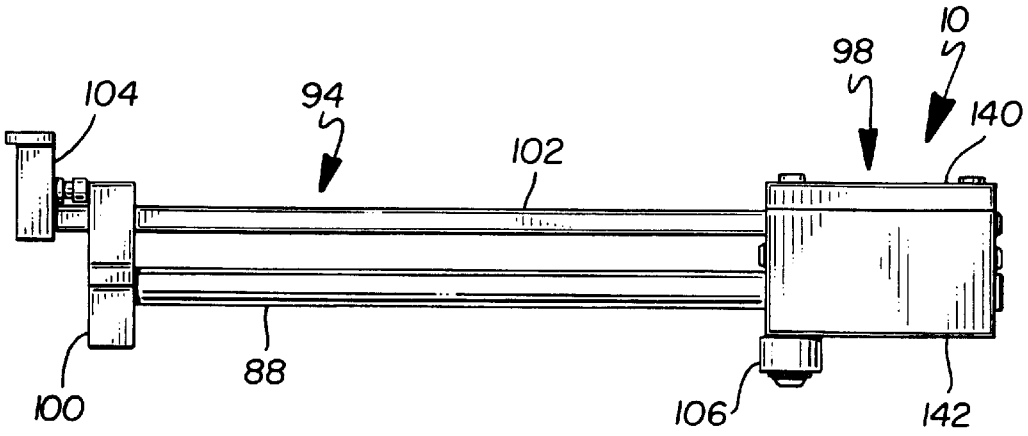
FIG. 7 is a side view of the loader arm assembly.
Figure 8:
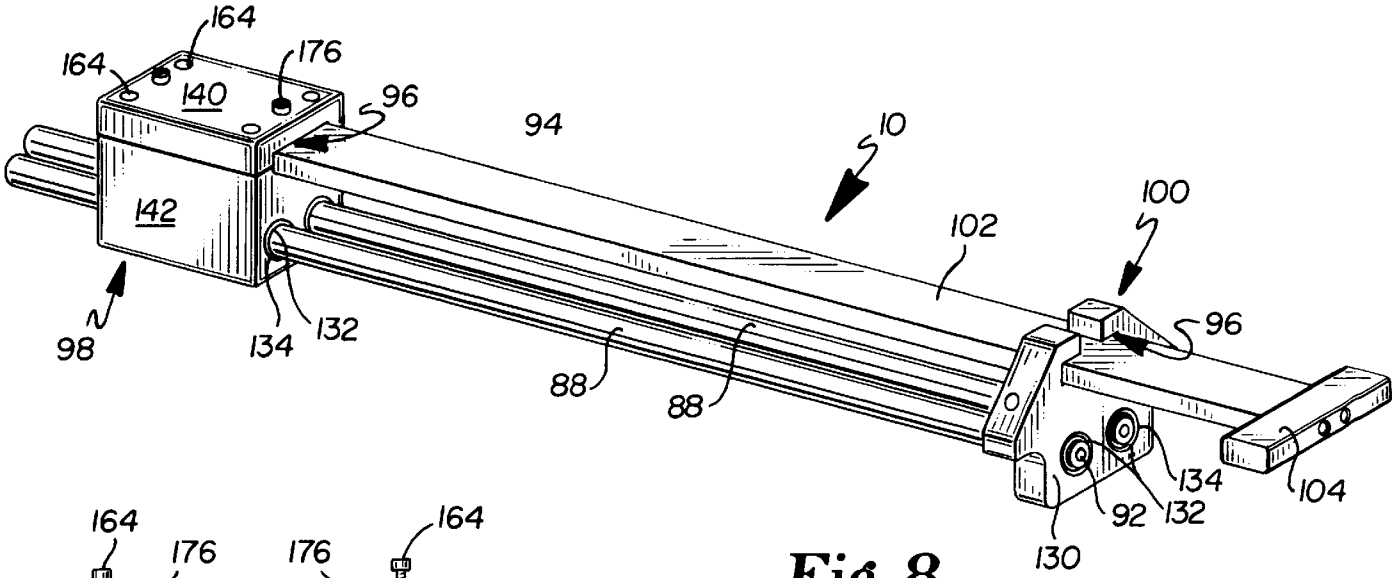
FIG. 8 is a perspective view of a partially-extended loader arm assembly.
Figure 9:
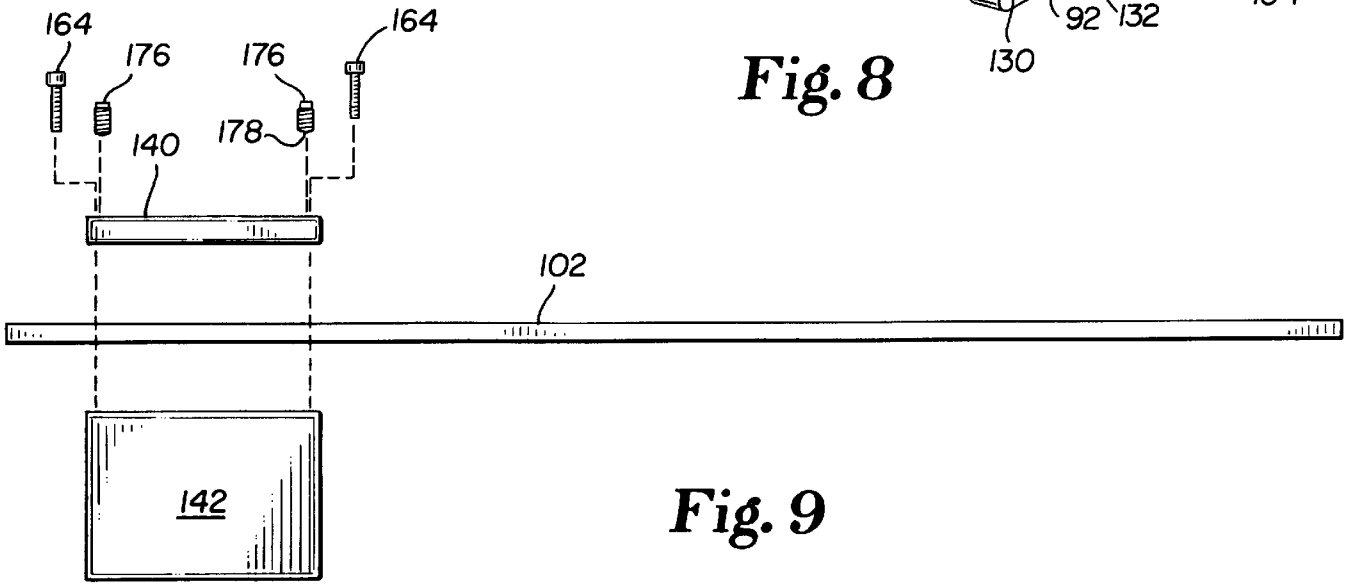
FIG. 9 is an exploded view of the base plate and housing of the loader arm assembly of FIG. 7.

Referring to FIGS. 1–14, an example of the preferred embodiment of the present invention is illustrated and generally indicated by the reference numeral 10. The barrel cam loader arm assembly 10 of the present invention is described and shown within a barrel cam loading mechanism 14 that is incorporated into a packaging system such as a continuous motion cartoner 12. The invention is described below first by describing a cartoner 12, which is illustrated in FIGS. 1–3, and then by describing the barrel cam loading mechanism 14, which is illustrated in FIGS. 4–6, and finally by describing the barrel cam loader arm assembly 10, which is illustrated in FIGS. 7–14.

Continuous Motion Cartoner

The cartoner 12 is a continuous, high-speed packaging mechanism adapted for packaging articles 20 or products of varying types, sizes and quantities into paper board carriers or cartons 22 of varying types and sizes in a reliable, continuous and high-speed process. For example, the cartoner 12 may package standard beverage cans or bottles into common single configurations or into stacked configurations. Moreover, the process of loading beverage containers into cartons 22, for example, is accomplished quickly and reliably, under typical industry tolerances for both container and carrier construction. The resultant filled cartons 22 output by the cartoner 12 are of uniform consistency having maximized squareness and tautness for improved storage qualities and transportability.

Figure 1:
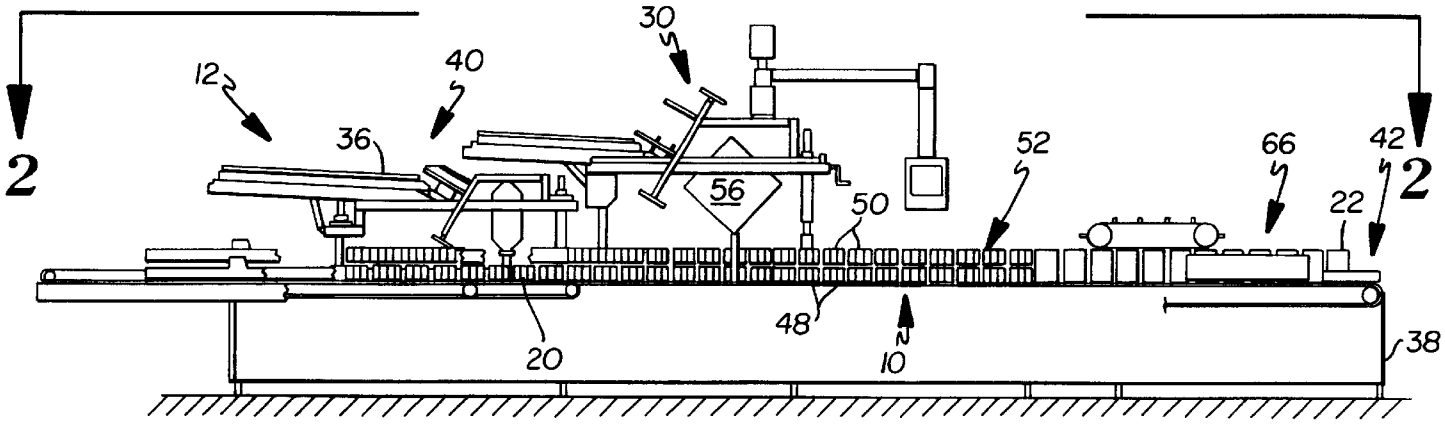
FIG. 1 is a side view of a cartoner incorporating the loader arm assemblies of the present invention within a barrel cam loading mechanism.
Figure 2:
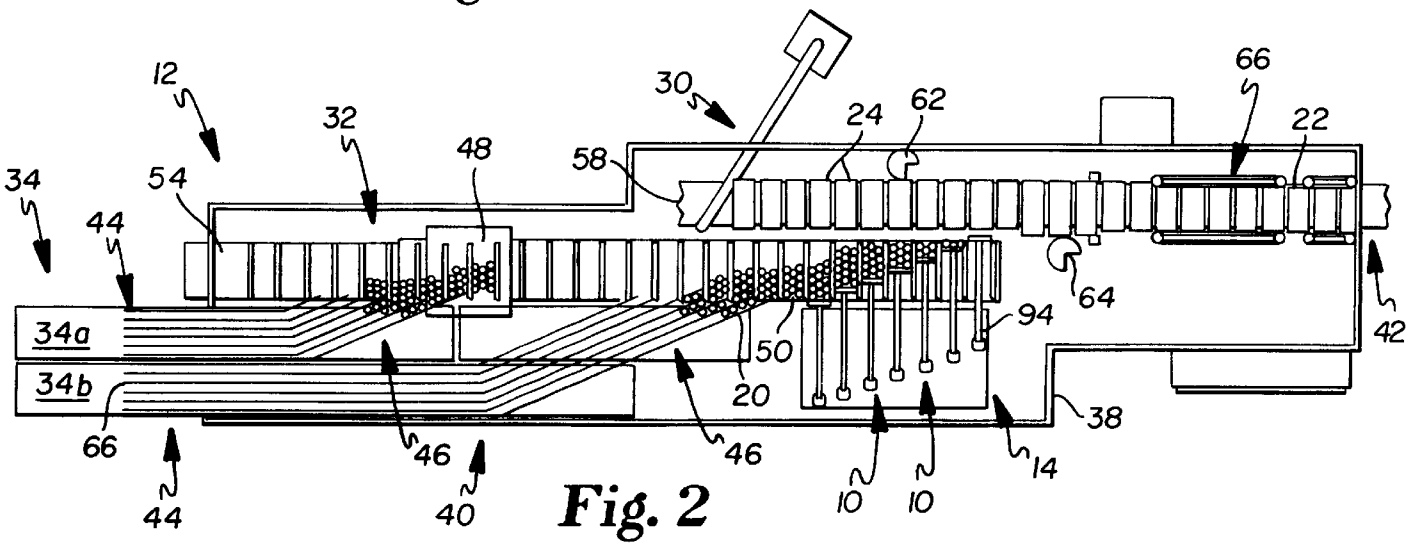
FIG. 2 is a top view of the cartoner taken along line 2—2 of FIG. 1.
Figure 3:
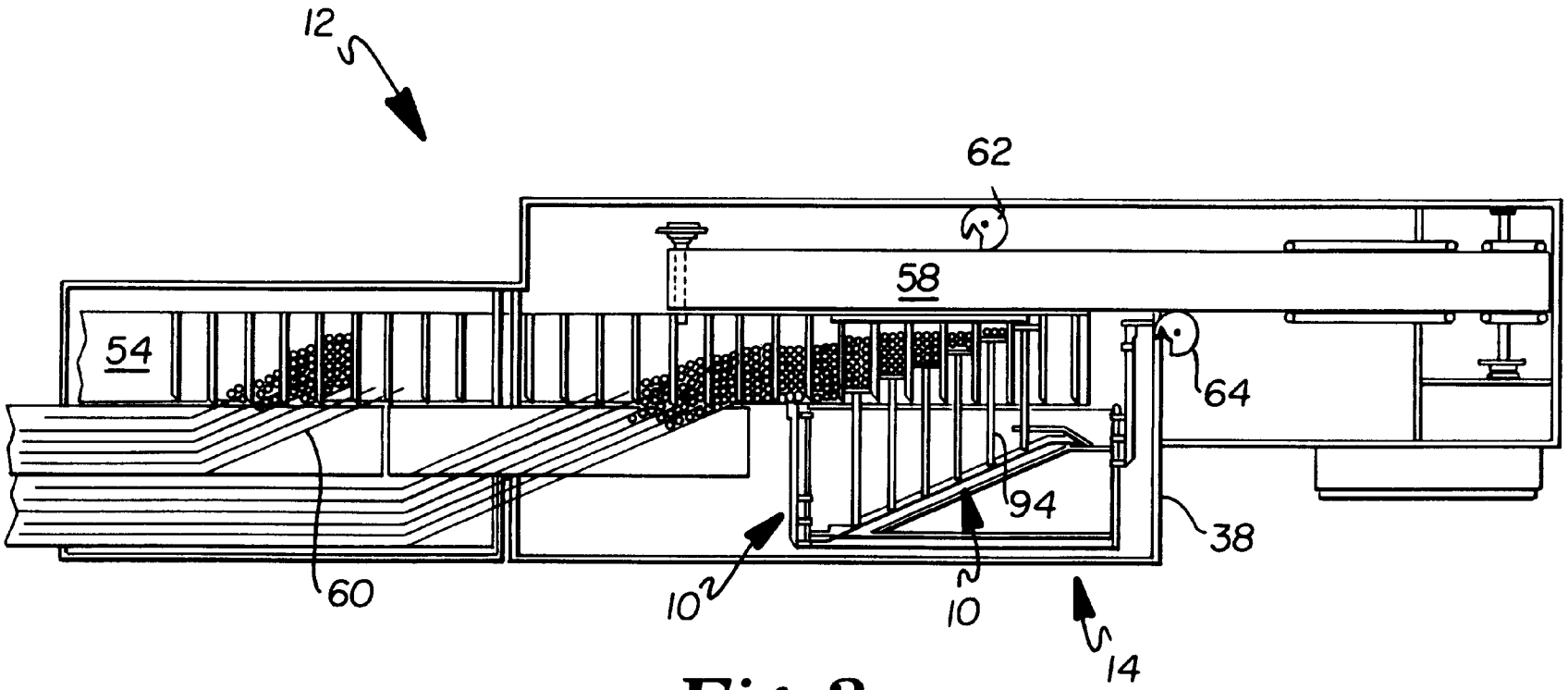
FIG. 3 is a top view of the barrel cam loading mechanism incorporated into the cartoner.

Referring to FIGS. 1–3, the cartoner 12 generally comprises a carton supply and transport mechanism 30 or stream, an article group selection and transport mechanism 32 or stream, a pair (for stacked article groups) of article supply mechanisms 34 or streams, a divider placement mechanism 36 used for stacked article groups, and an article group transfer apparatus, i.e. the cross-loading or barrel cam loading mechanism 14. These mechanisms are shown to be supported by a unitary frame structure 38, although if aligned properly, separate support structures may be utilized consistent with the teachings of this invention.

The carton supply placer 56 of the carton supply and transport mechanism 30 is disposed proximate to an input end 40 of the cartoner 12, and carton sleeves or blanks 24 are subsequently transported in a linear fashion on a carton transport conveyor 58 to an output end 42. The article supply mechanism or mechanisms 34 are also disposed at the input end 40. Two article supply mechanisms 34 are used in a cartoner 12 adapted for packaging articles in a stacked configuration comprised of two layers. A first portion 44 of each article supply mechanism 34 is disposed spatially parallel to the article group selection and transport mechanism 32, and a second portion 46 merges, at a predetermined angle, with the article group selection and transport mechanism 32 to supply streams of product or articles to two separate positions along the article group selection and transport mechanism 32. These merging mechanisms are further constructed and arranged to meter individual articles, via a fixed flight bar arrangement, into predetermined article groups on the mechanism.

In the cartoner embodiment adapted for packaging stacked article groups shown in the figures, the stacking function of the device is accomplished by forming a first group 48 at a low level, placing a divider sheet on the lower group via the divider sheet placement mechanism 36, and then simultaneously forming a second group 50 downstream at a higher level and allowing the upper group 50 to slide across the divider sheet by the action of the flight bars of the article group selecting portion of the mechanism 32 to form the stacked group 542. The divider placement mechanism 36 preferably comprises a rotary placer mechanism.

The article group selection and transport mechanism 32 is disposed adjacent and parallel to the carton supply and transport mechanism 30 and extends downstream, in a linear orientation. Merged or combined article groups 52 are transported downstream on an article group transport conveyor 54 in a spaced and metered fashion, each group being aligned with a carton sleeve 24 traveling on the carton transport conveyor 58.

The barrel cam loading mechanism 14 is disposed adjacent to and parallel with the article group transport conveyor 54, and extends and travels longitudinally with respect to the cartoner 12. The barrel cam loading mechanism 14 has a plurality of loading arm assemblies 10, including arms that extend transversely or perpendicularly with respect to the article group and carton transport conveyors 54 and 58. The loading arms 10 move product on the article group transport conveyor 54 into aligned carton sleeves 24 traveling on the carton transport conveyor 58, thereby loading the carton sleeves 24 with the articles 20.

The carton supply and transport mechanism 30 preferably includes a rotary type carton supply placer 56. The carton supply placer 56 is supported above the input end 40 of the carton supply and transport mechanism 30 by a vertically adjustable frame structure, and basically transfers flat carton blanks or sleeves 24 from a power magazine to the surface of the carton transport conveyor 58 and simultaneously opens the blank so that it assumes a four-sided configuration with opposing open ends bounded by at least one flap each. The partially erected carton, i.e. carton sleeve 24, is placed in a transverse or lateral orientation so that its ends are open to the sides of the carton transport conveyor 58 for loading purposes. The carton transport conveyor 58 receives cartons from the carton supply placer 56 and transports them linearly downstream with respect to the overall cartoner 12. The downstream transport of carton sleeves 24 is synchronized with the article group selection and transport mechanism 32 and with the barrel cam loading mechanism 14, as described further below, to effectuate carton loading. The carton transport conveyor 58 is adjustable to accommodate cartons of varying types and sizes, and basically comprises a plurality of flight lugs which are connected to a pair of flight chains that are connected to and revolve about drive and idler ends. The number of lugs per carton may be varied for alternative carton configurations, and the transverse and longitudinal spacing between lugs on the parallel, side-by-side chains is preferably variable to allow a variety of carton configurations to be received on the carton transport conveyor. Adjustment is desirable to permit the apparatus to be used with various carton configurations to allow for adjustment of carton spacing. The carton supply and transport mechanism 30 may also include a carton stabilization structure to support the tops of the relatively tall, bi-level carton sleeves 24 traveling on the mechanism, particularly during the loading phase of operation.

The first or lower article supply mechanism 34*a* provides a plurality of input individual articles at a first predetermined level or height and at a predetermined point on the article group selection and transport mechanism 32. The lower article supply mechanism 34*a* is shown to comprise a conveyor disposed about a drive sprocket/shaft assembly and an idler sprocket/shaft assembly. The conveyor preferably consists of a unitary belt. Articles transported on the top, forward run of the conveyor are separated into a plurality of single file paths by lane separators 60. Each lane separator has a terminal portion of a predetermined length, such that it extends into the path of the article group selection and transport mechanism 32. Each terminal portion is constructed such that it allows longitudinally transported flight structures of the article group selection and transport mechanism 32 to pass through the angled conveyance lanes. As the flight bars mesh with and pass through the lane separator end portions, they engage articles disposed in lanes and rake them onto the longitudinal conveyance path of the mechanism and between adjacent flight bars. The combination of forces exerted by the flight bars, lane ends, and conveyor serve to select and meter individual articles into predetermined article groups 48 which are fully merged onto the article group selection and transport mechanism 32. The size, orientation and dimensions of the resultant product groups are dependent upon the number of infeed lanes, product dimensions, and the configuration and spacing of the flight bars. Lanes may be blocked off by closure means to alter the group size and/or orientation. The lane separators and the flight bars are adjustable to provide full variability of product group parameters.

The article group selection and transport mechanism 32 selects article groups 48 from the first or lower article supply mechanism 34*a* as set forth above and from the second or high article supply mechanism 34*b* discussed below, and transports them linearly downstream with respect to the overall cartoner 12. The downstream transport of article groups 48 is synchronized with the carton supply and transport mechanism 30 and with the barrel cam loading mechanism 14, as described further below, to effectuate carton loading. The article group selection and transport mechanism 32 comprises a conveyor 54, a plurality of flight bar assemblies fixed to and longitudinally transported on the conveyor, and a plurality of slide plates, which are disposed on the conveyor between the spaced flight bars. The conveyor 54 includes a drive sprocket/shaft assembly, an idler sprocket/shaft assembly, and a pair of parallel endless conveyor chains that are connected to and revolve about the sprocket/shaft assemblies to form a longitudinally extending forward or top run and a return or bottom run. The flight bar assemblies include a top rail member and a bottom rail member that are connected to one another by vertical spacers. The top and bottom members are disposed parallel to one another and are spatially separated by the spacers. Each top and bottom member further has an angled front end and an elongated, rectilinear body terminating in a flat back end. The front end slants or angles inwardly from its leading edge to its trailing edge to enable the flight bars to select individual articles disposed in the article infeed lanes and to separate them from the closely spaced nearest upstream article. A pair of fixed slide plates are connected to each flight bar assembly. Both the flight bars and the slide plates are connected to the flight chains via connection brackets. The slide plates are thin, flat structures with a low friction top surface which support the lower article groups and further permit sliding movement thereon. Additionally, slotted slide plates are disposed between adjacent flight bar assemblies.

The second or higher article supply mechanism 34*b* provides a plurality of input individual articles to the apparatus at a second predetermined level or height and at a predetermined point downstream from the lower article supply mechanism 34*a*. The higher mechanism 34*a* also comprises a conveyor disposed about a drive sprocket/shaft assembly and an idler sprocket/shaft assembly. Articles transported on the top, forward run of the conveyors are separated into a plurality of single file paths by lane separators 60. Each lane separator 60 has a terminal portion of a predetermined length, such that it extends into the path of the article group selection and transport mechanism 32 a predetermined distance. Each terminal portion is constructed such that it allows the longitudinally transported flight structures of the article group selection and transport mechanism 32 to pass through angled conveyance lanes. As the flight structures mesh with and pass through the lane separator end portions, they engage articles disposed in lanes and rake them onto the longitudinal conveyance path of the mechanism.

Lateral and medial flap tuckers 62 and 64 are disposed adjacent each side of the carton transport mechanism, one 62 anterior to the loading region to provide a closed carton backside against which the loaded containers may nest and the other 64 posterior to the loading region to allow article group ingress to the carton through its open, unglued end flaps. Gluing, compression, and discharge mechanisms 66 are disposed further downstream and adjacent the carton supply and transport mechanism 30 to complete the carton flap securement process and form the fully formed, loaded cartons 22.

Barrel Cam Loading Mechanism

The barrel cam loading mechanism 14 is synchronized with the aforementioned apparatus elements to move completed article groups traveling on the article group selection and transport conveyor 54 into aligned carton sleeves 24 traveling on the carton transport conveyor 58. The barrel cam loading mechanism 14 basically comprises a plurality of loader arm assemblies 10, a flight chain and guide tube assembly 72 to which the loader arm assemblies 10 are attached at predetermined intervals and that provides a longitudinal movement component thereto, and a control cam assembly 74 which provides a predetermined transverse motion component to the loader arm assemblies 10. The flight chain and guide tube assembly 72 has a forward or top run 76 and a return or bottom run 78 and comprises drive and idler sprocket/shaft assemblies 80 and 82 and a pair of spatially parallel flight chains 84 which are connected to and revolve about the sprocket/shaft assemblies. The flight chains 84 are maintained in a rectilinear configuration on both the top and bottom runs by chain guides 86, which are linked to the frame 38 via vertical support members.

Pairs of elongated guide tubes 88 are disposed at predetermined intervals along the flight chains 84. The chains 84 are linked together by link pins 90, a predetermined number of which extend and are sized to fit into the end openings 92 of the guide tubes 88. Each guide tube 88 is directly connected at one end to the outer flight chain and at its opposite end to the inner flight chain so that they are oriented transversely with respect to the axis of the apparatus and to the downstream or forward run 76 of the barrel cam loading mechanism 14. The guide tubes 88 have a low friction exterior surface to provide slidable support of the loader arm assemblies 10. Each pair of closely spaced tubes 88 increase the stability of transverse movement of the arm 94. Further stability is attained by guide passages 96 in a housing 98 and a guide block 100. The spacing between successive sets (pairs) of tubes 88 corresponds to the spacing between the flight bars of the article group selection and transport conveyor 54 and between the flight lugs of the carton transport conveyor 58 so that the loader arm assemblies 10 are aligned to push product groups from between the flight bars into the carton sleeves 24.

The loader arm assemblies 10 are movably mounted on the guide tubes 88, and in a transverse orientation with respect to the axis of the cartoner 12. Each loader arm assembly 10 basically comprises the arm 94, which includes a base plate 102 and a loading head 104 located at one end of the base plate 102, and further comprises the housing 98 and the guide block 100. The arm assemblies 10 are conveyed in a downstream, longitudinal direction while the arms 94 simultaneously reciprocate in a transverse direction under the control of the control cam assembly 74 described below. A rotatable cam follower 106 cooperates with the cam assembly 74 to cause the arm 94 to transversely reciprocate on the guide tubes 88 and through the guide passages 96 of the housing 98 and the guide block 100.

A transition conveyor is disposed between the barrel cam loading mechanism and the carton transport mechanism to provide a moving base for the movement of the article groups into the longitudinally conveyed carton sleeves 24. A fixed dead plate may alternatively be used. The bottom member of the flight bars is elongated to extend across the top run of the transition conveyor to guide or funnel article groups across the conveyor and into the carton sleeves 24 between the carton end panels.

The control cam assembly 74 controls the transverse, reciprocal motion of the arm 94 in each loader arm assembly 10, is generally oriented longitudinally with respect to the overall barrel cam loading mechanism 14, and has a top or forward run 76 and a bottom or return run 78. The top run 108 basically comprises an inwardly sloping approach segment 112, an apex 114, and an outwardly sloping return segment 116. In the approach segment 112 the cam followers 106, and thus the arms 94, are urged inwardly and drive the loading head 104 of each arm 94 into moving engagement with a product group until it is loaded in a carton sleeve. A lag segment 118 of decreased slope is disposed at a predetermined point where the loading head 104 first contacts the article group to provide gentle, even pressure at this initial contact point. In the return segment 116, the loading head 104 is retracted from the carton sleeve prior to its being reset in the return run 110 of the cam assembly 74. The bottom or return run 110 of the cam assembly includes guide plates and a bottom cam rail which contacts the cam follower to further retract and reset the arms 94 for further loading cycles.

The forward run 108 of the cam assembly 74 comprises and outer rail 120 and an inner rail 122 that is spaced from the outer rail 120 a distance to form a pathway 124 adapted for receiving the cam followers 106. The motion of the followers 106 in the cam pathway 124 effectuates transverse, inward motion to the housing 98. The outer rail 120 of the cam 74 assembly may be connected to a pivot point at one end and to a release mechanism, such as a pressure release cylinder and piston, proximate its opposite end. The release mechanism is controlled by a sensing mechanism such as a photoeye or capacitive proximity sensor so that an excessive force placed on the outer rail due to a jamming of the arm assembly, for example, will actuate the release mechanism that in turn releases the outer rail to pivot away. This release mechanism design provides one means for detecting and relieving the pressure associated with a load jam. Another means is described in more detail below with respect to the barrel cam loader arm assembly 10.

Barrel Cam Loader Arm Assembly

Referring to FIGS. 7–14 along with FIGS. 4–6, each of the barrel cam loader arm assemblies 10 is connected to and longitudinally transported by the flight chain and guide tube assembly 72 and is further in operable contact with the control cam assembly 74. Each loader arm assembly 10 generally comprises an arm 94, a housing 98, and a guide block 100. The arm 94 includes a base plate 102 sized and shaped to be received by guide passages 96 formed in the housing 98 and guide block 100, and further includes a loading head 104 attached to an inner end of the base plate 102, and means for detecting a load jam described in more detail below. The base plate 102 is illustrated as having a rigid, flat, elongated structure that is oriented horizontally, and the loading head 104 is illustrated as having a single flat face member. Alternative designs are anticipated. As the arm assemblies 10, particularly the arms 94, move forward, the loading head 204 push the article groups forward from the article group selection transport conveyor 54 into the carton sleeves 24. The loading head configuration may be modified for cartoning various other products and product group arrangements or configurations, including non-stacked and stacked configurations.

Both the housing 98 and guide block 100 include a body portion 142 and 130 with a pair of guide tube apertures 132 and a bushing 134 within each aperture 132. The pair of guide tube apertures 132 are sized and arranged to slidably receive the pair of guide tubes 88. Thus the housing 98 and guide block 100 provide the arm 94 with attachment means to the flight chain and guide tube assembly 72, which provides longitudinal motion to the loader arm assemblies 10. The housing 98 contacts and supports the base plate 102 near the outside end of the arm 94, and the guide block 100 contacts and supports the base plate 102 near the inside end.

Figure 10:
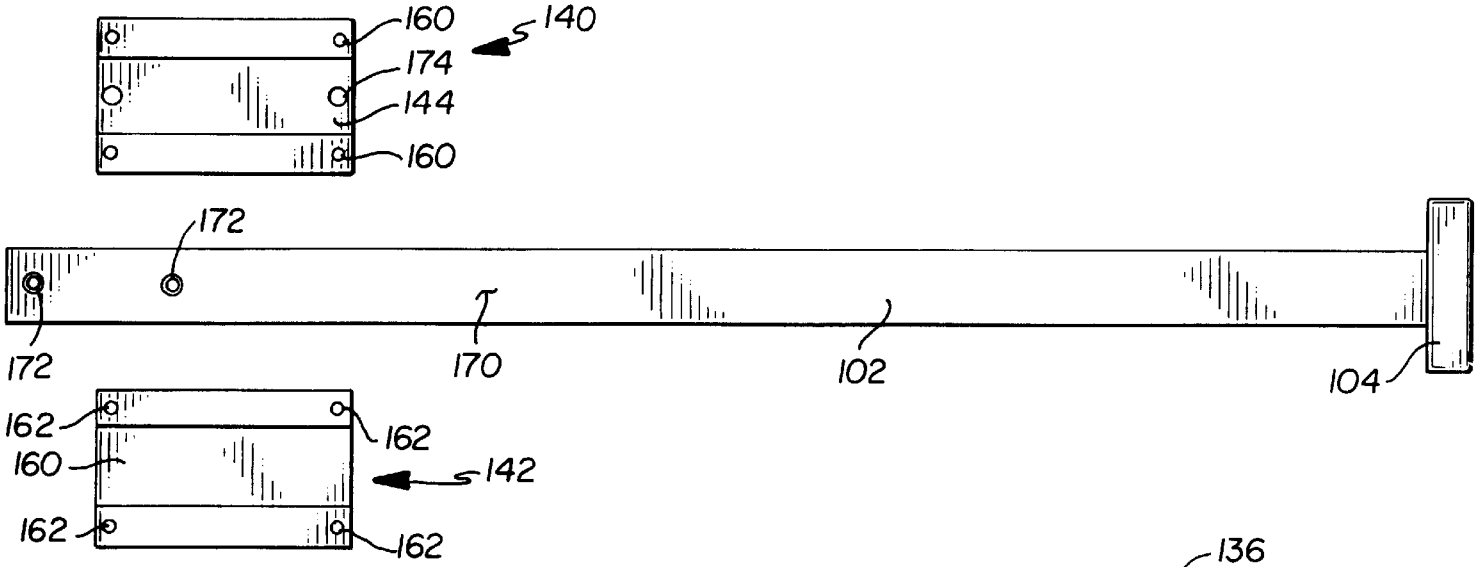
FIG. 10 is plan view illustrating the inside of the cover portion and body portion of the housing, and the top surface of the base plate.
Figure 11:
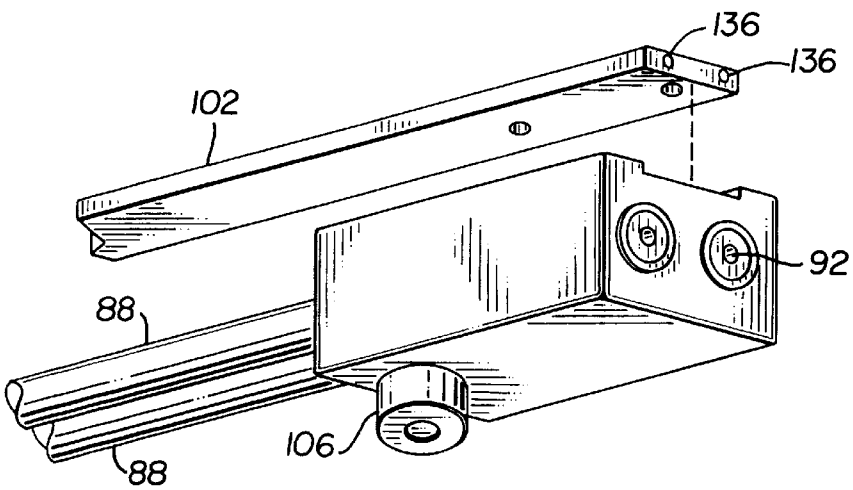
FIG. 11 is a perspective view illustrating the bottom of the body portion of the housing.

Referring to FIG. 10, the housing 98 further includes a cover portion 140 that is cooperatively attached to the body portion 142. Both the cover portion 140 and the body portion 142 are formed with a channel 144 constructed and arranged to form the guide passage 96 when the cover portion 140 is attached to the body portion 142. The cover portion 140 has a set of fastener apertures 160 and the body portion has a corresponding set of threaded fastener apertures 162. Fasteners 164 are screwed through both sets of apertures 160 and 162 to securely fasten the cover portion 140 to the body portion 142. Additionally, as illustrated in FIG. 11, the bottom of body portion 142 has a threaded cam follower aperture which is adapted to receive a threaded end of a rotatable cam follower 106. The control cam assembly 74 contacts and influences the cam follower 106, which in turn influences the housing 98 of the loader arm assembly 10 to move in a transverse, reciprocating motion.

Figure 12:
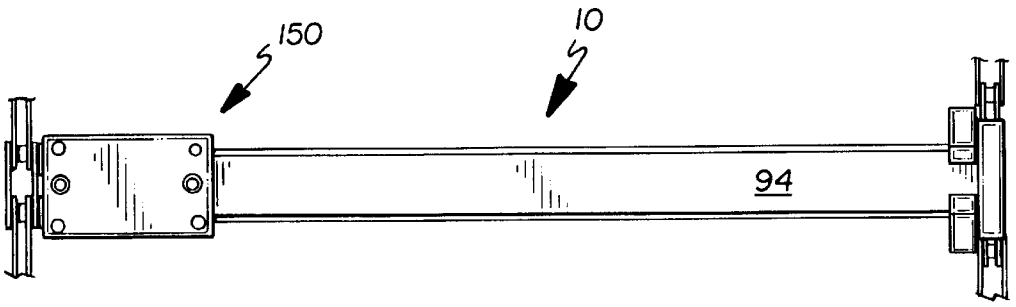
FIG. 12 is a top view of the loader arm assembly when the arm is in a retracted, latched state.
Figure 13:
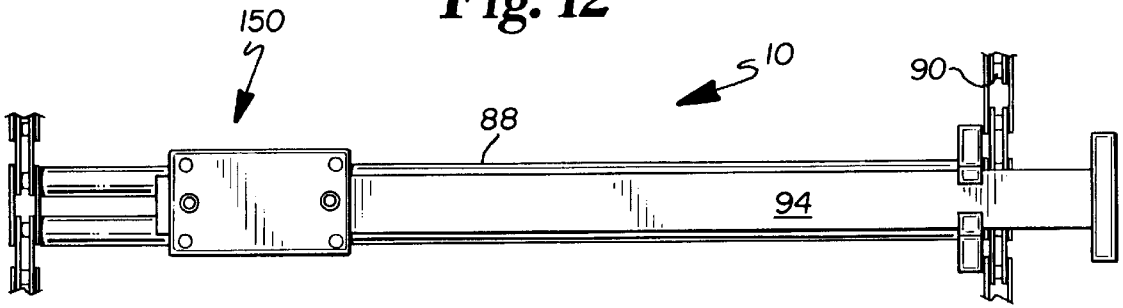
FIG. 13 is a top view of the loader arm assembly when the arm is in a partially extended, latched state.
Figure 14:
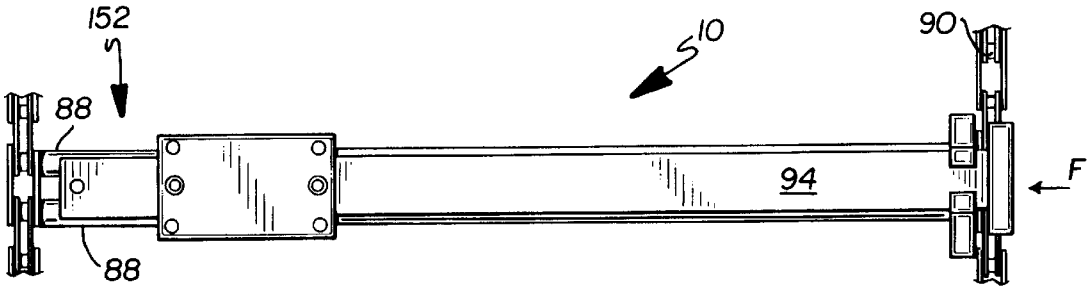
FIG. 14 is a top view of the loader arm assembly when the arm is in a partially extended, released state.

Referring to FIGS. 12–14, the base plate 102 is either in a latch state 150 or in a slidable or release state 152 within the guide passage 96 of the housing 98 because of the means for detecting a load jam described below. In the latch state 150, shown in FIGS. 12–13, the housing 98 holds and moves the arm 94 with it as it travels in the transverse, reciprocating motion. However, in the release state 152 shown in FIG. 14, the arm 94 will not move forward with the housing 98, but will slide within the guide passage 96 of the housing 98 because of the force F associated with a load jam. Holding screws, not shown, may be turned into apertures 136 to prevent the base plate 102 from sliding out of the housing 98.

The elements that comprise the means for detecting a load jam condition, or load jam detector, for the illustrated embodiment is described below. The top surface 170 of the base plate 102 of the arm 94 includes at least one concave depression 172 at a predetermined location, illustrated at the first end of the base plate 102 so that the housing 98 is near the edge of the first end when the arm is in the latch state 150. The depression(s) have a predetermined size and shape. The cover portion 140 includes at least one threaded aperture 174 into which a plug 176 or set screw may be turned. The tip 178 of the plug(s) 176 has a rounded size and shape to cooperate with the size and shape of the depression(s) 172, thus forming a detent. The tip(s) 178 remains seated within the depression(s) 172 when the arm 94 is in the latched state 150, and is moved or forced from the depression(s) 172 and slides along the surface 170 of the base plate 102 when the base plate 102 of the arm 94 is in the released state 152. Thus, the depression(s) 172 and plug(s) 176 function to provide means for the housing 98 to hold and move the arm 94 with the cam follower 106 in the latch state 150 and to release the arm 94 from moving with the cam follower 106 upon the detection or the application of a force F associated with a load jam and are considered means for detecting a load jam.

The number of depressions 172 and plugs 176, the shape of the plug tip 178 and the shape and depth of the depression 172, and the normal or holding force applied to the depression 172 that is adjusted by turning the plug 176 in the cover portion 140 all contribute the magnitude of the load jam force required to change the arm 94 from the latched state 150 to the released state 152. Therefore, the sensitivity of this individual load jam detection feature can be adjusted to sense small load jam forces to prevent damage to delicate articles and cartons, or to sense larger load jam forces to enable sturdier article groups to be packaged into sturdier cartons without being overly sensitive to a load jam. It is anticipated that alternative arrangements of detent(s) and depression(s) may be used, and it is further anticipated that alternative means for providing an adjustable holding force may be used as well. Two depressions 172 and two plugs 176 are shown in the figures.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A loader arm assembly for use in a packaging system, comprising:

(a) an arm;

(b) a housing operably connected to at least one motive mechanism, said housing being adapted for moving said arm to load product into a package;

(c) means for detecting a load jam condition, said arm having a latched state and a released state with respect to said housing, said arm normally being in said latched state to load product into said package, said arm entering said released state upon detecting said load jam condition, and said arm including a base plate and a loading head, said base plate having a first end and a second end, said first end of said base plate being latched to said housing when said arm is in said latched state, said base plate being adapted for sliding relatively with respect to said housing when said arm is in said released state, said second end of said base plate being connected to said loading head, said housing is formed with a guide passage adapted for receiving said base plate, said means for detecting a load jam includes at least one detent adapted for holding said base plate with respect to said housing in said latched state, and said at least one detent is formed by a tip of at least one plug extending through said housing to said guide passage, said tip being adapted for applying a holding force against said base plate, said first end of said base plate having at least one depression adapted for receiving said tip of said at least one plug in said latched state and for releasing said tip to slide on a surface of said base plate upon the application of a predetermined load pressure attributable to said load condition.

2. The loader arm assembly of claim 1, wherein said at least one plug has threads and extends through a threaded aperture in said housing, whereby turning said at least one plug adjusts said holding force to either allow a smaller or require a larger load pressure to release said at least one plug tip from said at least one depression, and thereby providing said means for detecting a load jam with an adjustable sensitivity.

3. The loader arm assembly of claim 1, wherein said housing comprises a body portion and a cover portion removably attached to said body portion, both said body portion and said cover portion having cooperating channels to form said guide passage.

4. The loader arm assembly of claim 1, further comprising a guide block adapted for stabilizing said arm, said guide block having a guide passage adapted for slidably receiving said arm.

5. The loader arm assembly of claim 1, wherein said at least one motive mechanism includes both a flight chain and guide tube assembly adapted for providing a longitudinal motion to said housing and a control cam assembly operably positioned with respect to said flight chain and guide tube assembly to provide a lateral motion to said housing, said flight chain and guide tube assembly including a parallel pair of flight chains and at least one guide tube connected to and extending between said flight chains, said housing having at least one guide tube aperture adapted for slidably receiving said at least one guide tube, said housing including a cam follower adapted for operably contacting said control cam assembly, said control cam assembly influencing said housing to laterally move along said at least one guide tube as said flight chain and guide tube assembly longitudinally transports said housing.

6. A loader arm assembly for use in a continuous motion packaging system, comprising:

(a) an arm including a base plate and a loading head, said base plate having a first end and a second end, said second end of said base plate being connected to said loading head;

(b) a housing operably connected to a flight chain and guide tube assembly adapted for providing a longitudinal motion to said housing and to a control cam assembly operably positioned with respect to said flight chain and guide tube assembly to provide a lateral motion to said housing, said flight chain and guide tube assembly including a parallel pair of flight chains and at least one guide tube connected to and extending between said flight chains, said housing having at least one guide tube aperture adapted for slidably receiving said at least one guide tube, said housing including a cam follower adapted for operably contacting said control cam assembly, said control cam assembly influencing said housing to laterally move along said at least one guide tube as said flight chain and guide tube assembly longitudinally transport said housing and said arm in a longitudinal direction, said arm having a latched state and a released state with respect to said housing, said housing being formed with a guide passage adapted for receiving said base plate and for laterally moving said arm to load product into a package if said arm is in said latched state; and (c) at least one detent adapted for holding said base plate with respect to said housing in said latched state, said at least one detent providing said arm with both said latched state in which said arm moves laterally with said housing, and said released state in which said arm does not move laterally with said housing, said arm normally being in said latched state to load product into said package, said arm entering said released state upon detecting a load jam condition, said first end of said base plate being latched to said housing when said arm is in said latched state, said base plate being adapted for sliding with respect to said housing when said arm is in said released state.

7. A loader arm assembly for use in a packaging system, comprising:

(a) an arm including a base plate and a loading head, said base plate having a first end and a second end, said second end of said base plate being connected to said loading head, said first end of said base plate having at least one depression;

(b) a housing operably connected to both a flight chain and guide tube assembly adapted for providing a longitudinal motion to said housing and a control cam assembly operably positioned with respect to said flight chain and guide tube assembly to provide a lateral motion to said housing, said flight chain and guide tube assembly including a parallel pair of flight chains and at least one guide tube connected to and extending between said flight chains, said housing having at least one guide tube aperture adapted for slidably receiving said at least one guide tube, said housing including a cam follower adapted for operably contacting said control cam assembly, said control cam assembly influencing said housing to laterally move along said at least one guide tube as said flight chain and guide tube assembly longitudinally transport said housing and said arm in longitudinal direction, said arm having a latched state and a released state with respect to said housing, said housing including a body portion and a cover portion removably attached to said body portion, both said body portion and said cover portion having cooperating channels to form a guide passage adapted for receiving said base plate and for laterally moving said arm to load product into a package if said arm is in said latched state; and (c) at least one plug extending through said cover portion to said guide passage, said at least one plug having a tip functioning as a detent adapted for holding said base plate to said housing and for releasing said base plate to slide with respect to said housing, said at least one plug providing said arm with both said latched state in which said arm moves laterally with said housing and said released state in which said arm does not move laterally with said housing, said arm normally being in said latched state to load product into said package, said arm entering said released state upon detecting a load jam condition, said tip being adapted for applying a holding force against said base plate, said at least one depression in said base plate being adapted for receiving said tip of said at least one plug in said latched state and for releasing said tip to slide on a surface of said base plate upon the application of a predetermined load pressure attributable to said load jam condition, said at least one plug having threads and extending through a threaded aperture in said cover portion, whereby turning said at least one plug adjusts said holding force to either increase or decrease said predetermined load pressure that is attributable to said load jam condition.

8. A barrel cam loading mechanism, comprising:

(a) a plurality of loader arm assemblies, each loader arm assembly including:

(i) an arm;

(ii) a housing including a cam follower, said housing having at least one guide tube aperture, said housing being adapted for moving said arm to load product into a package;

(iii) means for detecting a load jam condition, said arm having a latched state and a released state with respect to said housing, said arm normally being in said latched state to load product into said package, said arm entering said released state upon detecting said load jam condition; and said arm includes a base plate and a loading head, said base plate having a first end and a second end, said second end of said base plate being connected to said loading head, said housing being formed with a guide passage adapted for receiving said base plate, said means for detecting a load jam including at least one detent adapted for holding said first end of said base plate with respect to said housing in said latched state, and said at least one detent is formed by a tip of at least one plug, said at least one plug having threads and extending through a threaded aperture in said housing to said guide passage, said tip being adapted for applying a holding force against said base plate, said first end of said base plate having at least one depression adapted for receiving said tip of said at least one plug in said latched state and for releasing said tip to slide on a surface of said base plate upon the application of a predetermined load pressure attributable to said load condition, whereby turning said at least one plug adjusts said holding force to either increase or decrease said predetermined load pressure that is attributable to said load jam condition;

(b) a flight chain and guide tube assembly adapted for providing a longitudinal motion to said housing of each of said loader arm assemblies, said flight chain and guide tube assembly including a parallel pair of longitudinally oriented flight chains and at least one guide tube for each of said plurality of loader arm assemblies connected to and laterally extending between said flight chains, said guide tube having a slidable fit within said guide tube aperture of said housing, said plurality of loader arm assemblies being disposed along said flight chains at predetermined longitudinally spaced intervals; and a control cam assembly operably positioned proximate to said flight chain and guide tube assembly to provide a lateral motion to said housing of each of said loader arm assemblies, said control cam assembly influencing said housing to laterally move along said at least one guide tube as said flight chain and guide tube assembly longitudinally transports said housing.

9. The barrel cam loading mechanism of claim 8, wherein said pair of flight chains extend about a drive shaft assembly and an idler shaft assembly to form a forward run and a return run, said flight chains comprising a plurality of links, adjacent links being connected together by a pin, said at least one guide tube having opposite end openings adapted to receive a pin from each of the pair of flight chains.

10. The barrel cam loading mechanism of claim 8, wherein said control cam assembly has a predetermined approach segment for providing a constant rate of lateral extension to said arms throughout a majority of a total extension path of said arms, a predetermined apex for providing a complete extension of said arms toward said package, and a return segment for retracting said arm away from said package.

11. The barrel cam loading mechanism of claim 8, wherein each of said loader arm assemblies further comprises a guide block adapted for stabilizing said arm, said guide block having a guide passage adapted for slidably receiving said arm.

12. A barrel cam loading mechanism for use within a packaging system, comprising:

(a) a plurality of loader arm assemblies, each loader arm assembly including:

(i) an arm;

(ii) a housing including a cam follower, said housing having at least one guide tube aperture, said second end of said base plate being connected to said loading head, said arm having a latched state and a released state with respect to said housing, said housing being formed with a guide passage adapted for receiving said base plate and for laterally moving said arm to load product into a package if said arm is in said latched state;

(iii) at least one detent adapted for holding said base plate with respect to said housing in said latched state, said arm normally being in said latched state to load product into said package, said arm entering said released state upon detecting a load jam condition, said at least one detent being formed by a tip of at least one plug, said at least one plug having threads and extending through a threaded aperture in said housing to said guide passage, said tip being adapted for applying a holding force against said base plate, said first end of said base plate having at least one depression adapted for receiving said tip of said at least one plug and for releasing said tip to slide on a surface of said base plate upon the application of a predetermined load pressure attributable to said load jam condition, wherein turning said at least one plug adjusts said holding force to either allow a smaller or require a larger load pressure to release said at least one plug tip from said at least one depression; and (iv) a guide block adapted for stabilizing said arm, said guide block having a guide passage adapted for slidably receiving said arm;

(b) a flight chain and guide tube assembly adapted for providing a longitudinal motion to said housing of each of said loader arm assemblies, said flight chain and guide tube assembly including a parallel pair of longitudinally oriented flight chains and at least one guide tube for each of said plurality of loader arm assemblies connected to and laterally extending between said flight chains, said guide tube having a slidable fit within said guide tube aperture of said housing, said plurality of loader arm assemblies being disposed along said flight chains at predetermined longitudinally spaced intervals; and (c) a control cam assembly operably positioned proximate to said flight chain and guide tube assembly to provide a lateral motion to said housing of each of said loader arm assemblies, said control cam assembly influencing said housing to laterally move along said at least one guide tube as said flight chain and guide tube assembly longitudinally transports said housing.

13. A loader arm assembly for use in a packaging system, comprising:

(a) an arm including a base plate and a loading head, said base plate having a first end and a second end;

(b) a housing operably connected to at least one motive mechanism and being adapted for moving said arm to load product into a package, said housing comprising a body portion and a cover portion removably attached to said body portion, both said body portion and said cover portion having cooperating channels to form a guide passage adapted for receiving said base plate, said first end of said base plate being latched to said housing when said arm is in said latched state, said base plate being adapted for sliding relatively with respect to said housing when said arm is in said released state, said second end of said base plate being connected to said loading head; and (c) means for detecting a load jam condition, said arm having a latched state and a released state with respect to said housing, said arm normally being in said latched state to load product into said package, said arm entering said released state upon detecting said load jam condition.

* * * * *